US007597426B2

(12) United States Patent
Ito

(10) Patent No.: US 7,597,426 B2
(45) Date of Patent: Oct. 6, 2009

(54) INK-JET HEAD AND INK-JET PRINTER

(75) Inventor: Atsushi Ito, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 532 days.

(21) Appl. No.: 11/591,816

(22) Filed: Nov. 2, 2006

(65) Prior Publication Data

US 2007/0103524 A1 May 10, 2007

(30) Foreign Application Priority Data

Nov. 4, 2005 (JP) ..... 2005-320934

(51) Int. Cl.
*B41J 2/45* (2006.01)
*B41J 2/05* (2006.01)

(52) U.S. Cl. ..... 347/68; 347/66

(58) Field of Classification Search ..... 347/54, 347/66, 68, 71

See application file for complete search history.

(56) References Cited

U.S. PATENT DOCUMENTS 4,695,854 A 9/1987 Cruz-Uribe
5,030,973 A * 7/1991 Nonoyama et al. ..... 347/93
5,402,159 A 3/1995 Takahashi et al.
5,748,214 A 5/1998 Usui et al.
5,872,583 A * 2/1999 Yamamoto et al. ..... 347/70
6,431,674 B2 8/2002 Suzuki et al.
6,799,821 B1 * 10/2004 Okuda ..... 347/10
6,905,202 B2 * 6/2005 Shimamoto et al. ..... 347/94

FOREIGN PATENT DOCUMENTS

JP 63-37958 2/1988
JP 4-341853 11/1992
JP 6-11542 2/1994
JP 3196800 6/2001

* cited by examiner

*Primary Examiner*—Anh T. N. Vo
(74) *Attorney, Agent, or Firm*—Reed Smith LLP

(57) ABSTRACT

An ink-jet head includes: a cavity unit having a nozzle row in which nozzles are arranged in a row, a common ink chamber, and ink channels connecting the common ink chamber with the nozzles, respectively; at least two air discharge ports for air-bubble discharge provided substantially on an extension line of the nozzle row; and a single air discharge-channel connecting the at least two air discharge ports and a portion in the common ink chamber disposed at most downstream of a flow of the ink. The ink channels and the air discharge-channel have substantially the same shape, and an opening area of each of the discharge ports is substantially same as that of the nozzles, thereby making channel resistance in the air discharge-channel lower than that in the ink channels, thereby efficiently removing air bubble stagnated in the common ink chamber at the most downstream portion in the ink flow.

12 Claims, 7 Drawing Sheets

INK-JET HEAD AND INK-JET PRINTER

CROSS REFERENCE TO RELATED APPLICATION

The present application claims priority from Japanese Patent Application No. 2005-320934 filed on Nov. 4, 2005, the disclosure of which is incorporated herein by reference in its entirety.

BACKGROUND OF THE INVENTION

1. Field of the Invention

The present invention relates to an ink-jet head which is constructed to distribute an ink supplied to a common ink chamber, and then discharge the distributed ink from nozzles, and an ink-jet printer which uses this ink-jet head.

2. Description of the Related Art

As an ink-jet head according to a prior art, there has been known a structure such as a piezoelectric ink-jet head described in Japanese Patent No 3196800 (corresponding to U.S. Pat. No. 5,748,214), in which an elastic plate is mounted on a cavity unit which includes a plurality of nozzles arranged in rows and pressure chambers for the nozzles, respectively, so that the elastic plate covers all the pressure chambers, and in which a piezoelectric element is provided on the elastic plate to correspond to each of the pressure chambers.

In the cavity unit, the ink supplied from an ink supply source is stored once in a common ink chamber which is provided in the cavity unit lengthwise along a direction of the nozzle rows. Next, the ink is distributed to each of the pressure chambers provided on a rear surface side of the cavity unit, and then the ink reaches each of the nozzles provided on a front surface side of the cavity unit. Further, for realizing such an ink channel in the cavity unit which is a very small component, the cavity unit is formed by laminating (stacking) a plurality of plates, each of which is provided with through holes and recesses of various sizes, with flat surfaces of the plates facing mutually.

The cavity unit in Japanese Patent No. 3196800 is formed such that an ink supply port is open towards the rear side of the cavity unit, as an inlet for supplying the ink from the ink supply source to the cavity unit, and this ink supply port is connected to one end in a longitudinal direction of the common ink chamber. Therefore, the ink which has flowed into the common ink chamber is distributed to the pressure chambers via holes formed in parallel in a direction in which the plates are laminated or stacked (laminating direction, stacking direction), while flowing from the one end in the longitudinal direction of the common ink chamber to the other end in the longitudinal direction of the common ink chamber, along a direction of plane of the plate. In other words, since the ink flows to the pressure chambers upon changing, its direction in which the ink flows in the common ink chamber, to another direction to flow into the pressure chambers by right angles, the ink is stagnated in the common ink chamber at the other end thereof which is the most downstream side in the ink flow, and consequently air bubbles mixed in the ink come or gather together and are easily stagnated. Therefore, there is a problem that, at a time of maintenance, even when a purge operation is performed to forcefully discharge the bubbles in the ink, together with the ink, the air bubbles stagnated at the other end in the common ink chamber are hardly removed.

Therefore, in Japanese Patent No. 3196800, by devising the arrangement of the holes (channel constricting holes in Japanese Patent No. 3196800), so that a flow of the ink which makes the air bubbles to be easily discharged, is developed in the common ink chamber. Specifically, among the holes, holes which communicate with nozzles, respectively, for image recording are arranged in a row along one wall surface in a longitudinal direction of the common ink chamber; and among the holes, a plurality of holes (three holes in FIG. 3) which communicate with a nozzle for air discharge (described as "air discharge port") are arranged, along a direction of a width of the common ink chamber, at an end of thereof located at the most downstream side in the longitudinal direction of the common ink chamber. The air discharge ports are arranged along a direction orthogonal to the nozzle row at an end of the nozzle row for image recording, corresponding to the arrangement of the holes for the air discharge. In this structure, when the purge operation for forcibly discharging the ink from the air discharge ports and the nozzles is performed, a flow of the ink (ink flow) is generated in the common ink chamber at the most downstream side end thereof, throughout the width of the common ink chamber, and the air bubbles, without being stagnated, are discharged promptly from the air discharge ports via the holes for the air discharge.

As in the ink-jet head described in Japanese Patent No. 3196800, in a structure including air discharge ports in a surface at which the nozzles are open, it is desired to improve the efficiency in discharging the air bubbles from the air discharge ports. For improving dischargeability of air bubbles in the air discharge ports, it is necessary to reduce a channel resistance in the air discharge port to be lower than a channel resistance in the nozzle for the image recording. For this purpose, it is conceivable, for example, to increase the number of air discharge ports, to increase an area of opening of the discharge ports to be greater than an area of opening of the nozzle for the image recording, and the like.

However, in ink-jet heads developed in recent years, there is a tendency that a planar area of the ink-jet head as a whole is reduced to be small in response to the reduction in size of the entire ink-jet head and the high densification of recording, whereas a space between the nozzle rows for image recording tends to be narrow due to the increase in the number of nozzles and nozzle rows. In the ink-jet head described in Japanese Patent No. 3196800, the plurality of air discharge holes and the plurality of air discharge ports are arranged along the width direction of the common ink chamber. In this arrangement, however, when the space between the rows becomes narrow, there is a limit up to which the space can be narrowed, and it has been difficult to increase the number of the holes for the air discharge and the air discharge ports.

On the other hand, when the air discharge ports are made to have an opening having a wider area than that of the nozzles for image recording, a meniscus pressure resistance is lowered only in the air discharge ports. In this case, a back pressure (negative pressure) acts to the ink in the ink-jet head as it has been publicly known, and further when there is a pressure fluctuation or the like, the meniscus is destroyed easily and outside air enters the common ink chamber through the air discharge ports, thereby forming a lump of air bubbles in the common liquid chamber. Then, the lump of air bubbles formed in the common ink chamber blocks the holes (channel constricting holes) each communicating with one of the nozzles for image recording, thereby causing a problem of defective ink jetting or discharge.

SUMMARY OF THE INVENTION

An object of the present invention is to realize an ink-jet head which is capable of efficiently removing an air bubble stagnating or remaining in the common ink chamber at a portion thereof on the most downstream side of the ink flow, and to realize an ink-jet printer provided with such an ink-jet head.

According to a first aspect of the present invention, there is provided an ink-jet head including:

a cavity unit including a nozzle row in which a plurality of nozzles for recording are arranged in a row, a common ink chamber extending along the nozzle row and distributing an ink, supplied from an ink supply source, to each of the nozzles, and ink channels connecting the common ink chamber with the nozzles, respectively;

at least two air discharge ports for air-bubble discharge which are provided substantially on an extension line of the nozzle row; and a single air discharge-channel which connects the at least two air discharge ports and a portion, of the common ink chamber, which is disposed at most downstream in a flow of the ink.

According to a second aspect of the present invention, there is provided an ink-jet printer which performs printing by jetting an ink onto a recording medium, the ink-jet printer including:

a transporting mechanism which transports the recording medium in a predetermined direction; and an ink-jet head which includes: a cavity unit having a nozzle row in which a plurality of nozzles for recording are arranged in a row, a common ink chamber extending along the nozzle row and distributing an ink, supplied from an ink supply source, to each of the nozzles, and an ink channels connecting the common ink chamber with the nozzles, respectively; at least two air discharge ports for air-bubble discharge which are provided substantially on an extension line of the nozzle row; and a single air discharge-channel which connects the at least two air discharge ports and a portion, of the common ink chamber, which is disposed at most downstream in a flow of the ink.

According to each of the structures described above, since the at least two air discharge ports for air-bubble discharge are provided substantially on an extension line of the nozzle row, the arrangement of nozzles is highly densified, and even when the nozzle row is provided as a plurality of nozzle rows and a space between the nozzle rows becomes narrow, it is possible to arrange, without difficulty, the air discharge ports for discharging the air bubble. Further, channel resistance in the air discharge-channel, to which the at least two air discharge ports are connected, is smaller than a channel resistance of each of the ink channels to which only one nozzle is connected. Accordingly, when the ink is sucked or pressurized forcibly by a purge operation or the like, a flow of the ink by a substantial amount is generated toward a downstream portion of the common ink chamber. Consequently, it is possible to efficiently discharge the air bubbles stagnating and remaining in the common ink chamber at the most downstream portion thereof.

In the ink-jet head and in the ink-jet printer of the present invention, an area of opening of each of the air discharge ports may be substantially same as or not more than an area of opening of each of the nozzles. In this case, meniscus pressure resistance in the discharge port becomes same or greater than meniscus pressure resistance in the nozzle, and even when any pressure fluctuation is further added to back pressure acting on the ink, there is no fear that external air enters through the air discharge port. Thus, it is possible to achieve a high reliability.

In the ink-jet head and in the ink-jet printer of the present invention, the cavity unit may be formed of a plurality of stacked plates; and the nozzles and the air discharge ports may be formed through a same plate among the stacked plates. In this case, since it is possible to form the air discharge ports and the nozzles by a same process and a same processing method (production method), it is possible to easily arrange the air discharge ports on the extension line of the nozzle row, and to easily process the air discharge ports to have openings similar to or same as those of the nozzles.

In the ink-jet head and in the ink-jet printer of the present invention, the air discharge-channel may have a shape substantially same as that of the ink channels. In this case, since a length and a cross-sectional area in a direction orthogonal to the ink flow are made to be the same among the air discharge channel and the ink channels, it is possible to form a plurality of ink channels and then to convert one of the formed ink channels to the air discharge-channel. Thus, there is no need to add a special process for forming the air discharge-channel.

The ink-jet head and the ink-jet printer of the present invention may further include pressure chambers each of which communicates with the common ink chamber and one of the nozzles; and a piezoelectric actuator which imparts an ink jetting energy to the pressure chambers; wherein the air discharge-channel may include a dummy pressure chamber having a shape same as that of each of the pressure chambers. In this case, since the pressure chambers and the dummy pressure chamber have a same shape, it is possible to convert one of the pressure chambers to the dummy pressure chamber. Thus, there is no need to perform a special process for forming the dummy pressure chamber.

DETAILED DESCRIPTION OF THE PREFERRED EMBODIMENTS

A basic embodiment of the present invention will be explained with reference to FIGS. 1 to 7.

Figure 1:
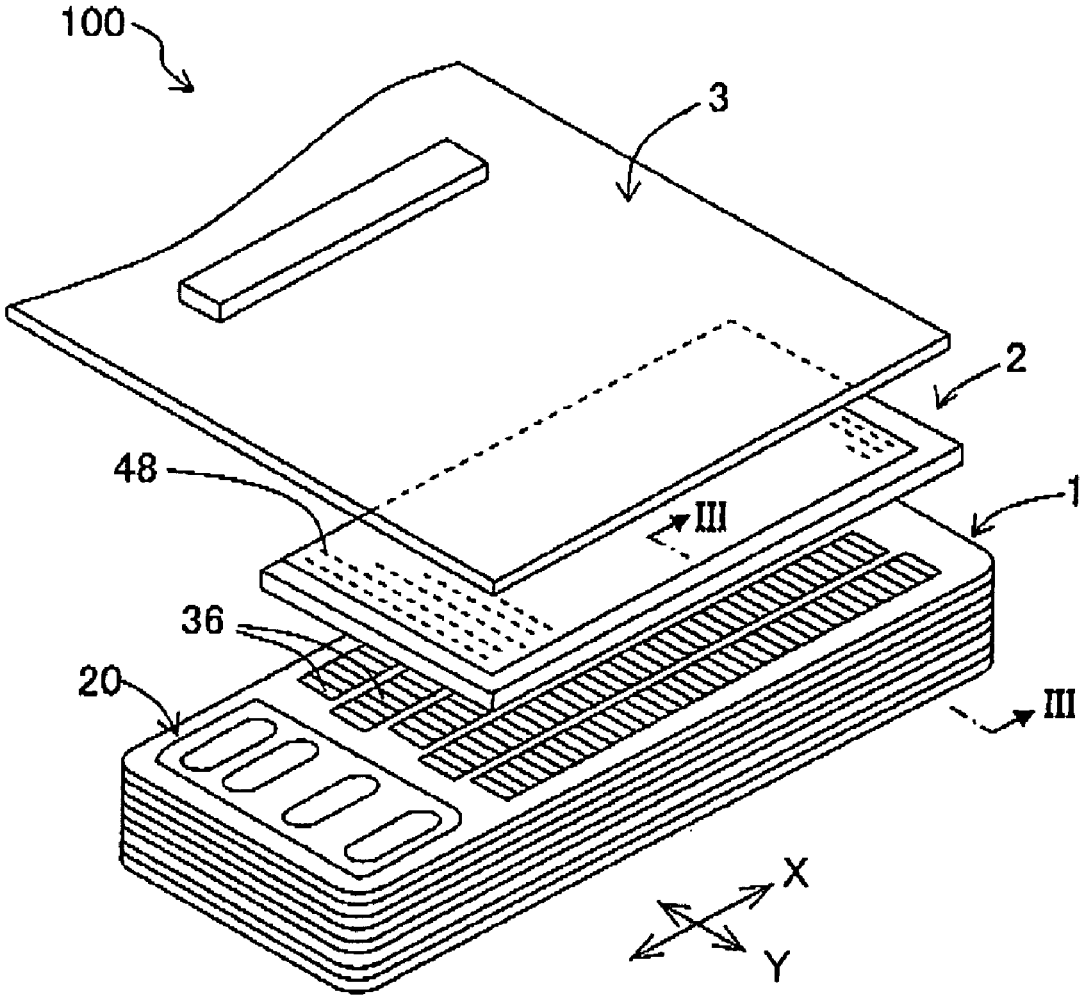
FIG. 1 is a perspective view of an ink-jet head according to an embodiment of the present invention.

FIG. 1 is a perspective view of a cavity unit 1 and a piezoelectric actuator 2 in an ink-jet head 100 of piezoelectric type in the embodiment, to which the present invention is applied. The piezoelectric actuator 2, which is a plate-type or plate-shaped actuator, is joined to the cavity unit 1 which includes a plurality of metallic plates, A flexible flat cable 3 for connection with an external equipment is overlapped with and joined to the upper surface of the plate-type piezoelectric actuator 2. In this ink-jet head 100, an ink is discharged downward from nozzles 4 which are open on a side of the lower surface of the cavity unit 1 (see FIG. 3).

Figure 2:
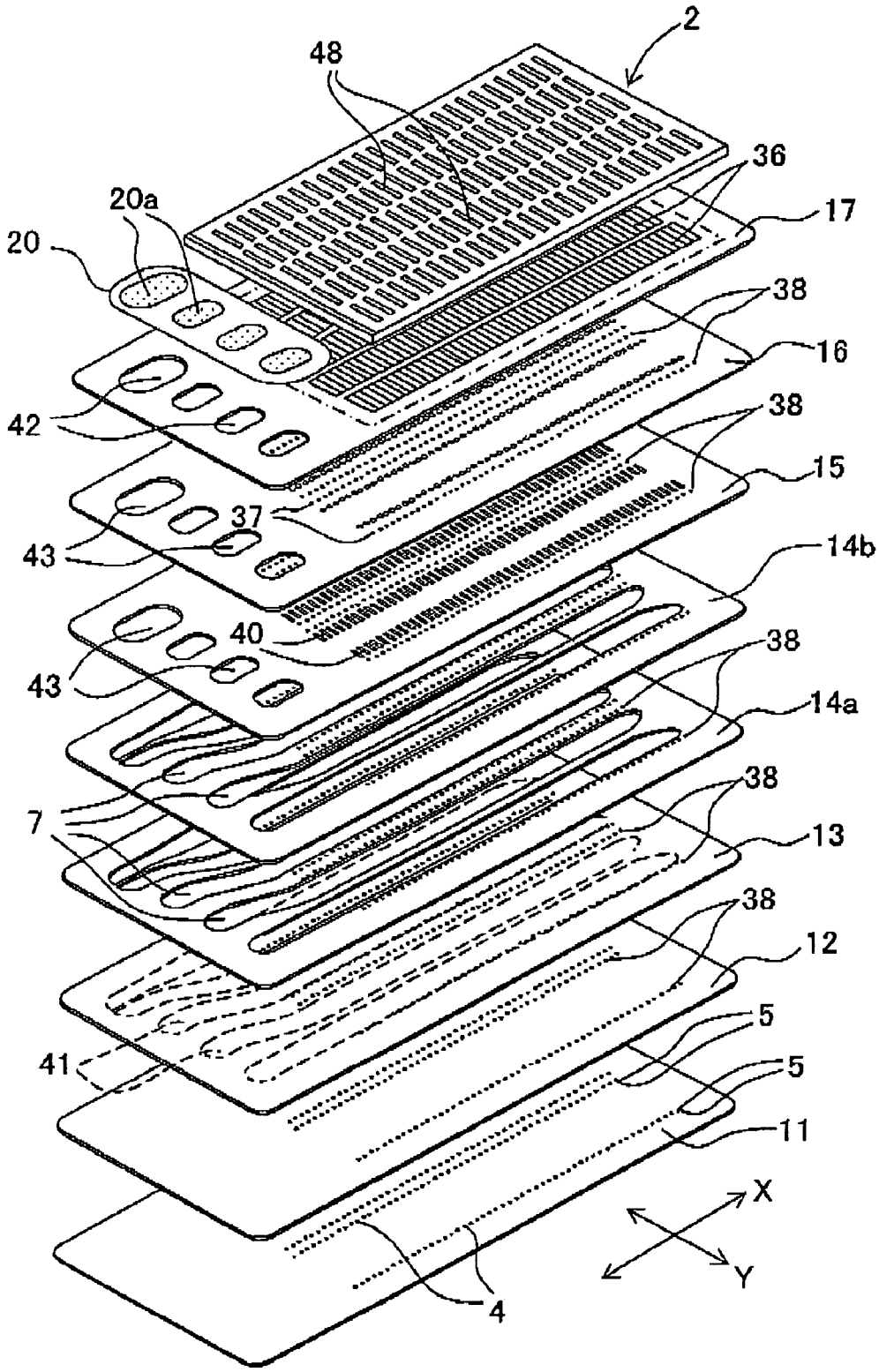
FIG. 2 is an exploded perspective view of the ink-jet head.

As shown in FIG. 2, the cavity unit 1 has a structure in which total of eight thin plates, namely a nozzle plate 11, a spacer plate 12, a damper plate 13, two manifold plates 14*a* and 14*b*, a supply plate 15, a base plate 16, and a cavity plate 17 are laminated or stacked with an adhesive such that thin plate surfaces of the respective plates are facing mutually and the plates are joined to overlap with one another.

In this embodiment, each of the plates 11 to 17 has a thickness of about 40 μm to 150 μm. The nozzle plate 11 is made of a synthetic resin material such as polyimde, and the remaining plates 12 to 17 are made of a 42% nickel alloy. A large number of nozzles 4 for recording (recording nozzles 4) having a very small diameter (about 25 μm) is formed through the nozzle plate 11. These nozzles 4 are arranged in five rows along a longitudinal direction (X direction) of the nozzle plate 11; and the rows are aligned corresponding to colors, respectively, of the ink to be jetted.

Figure 6:
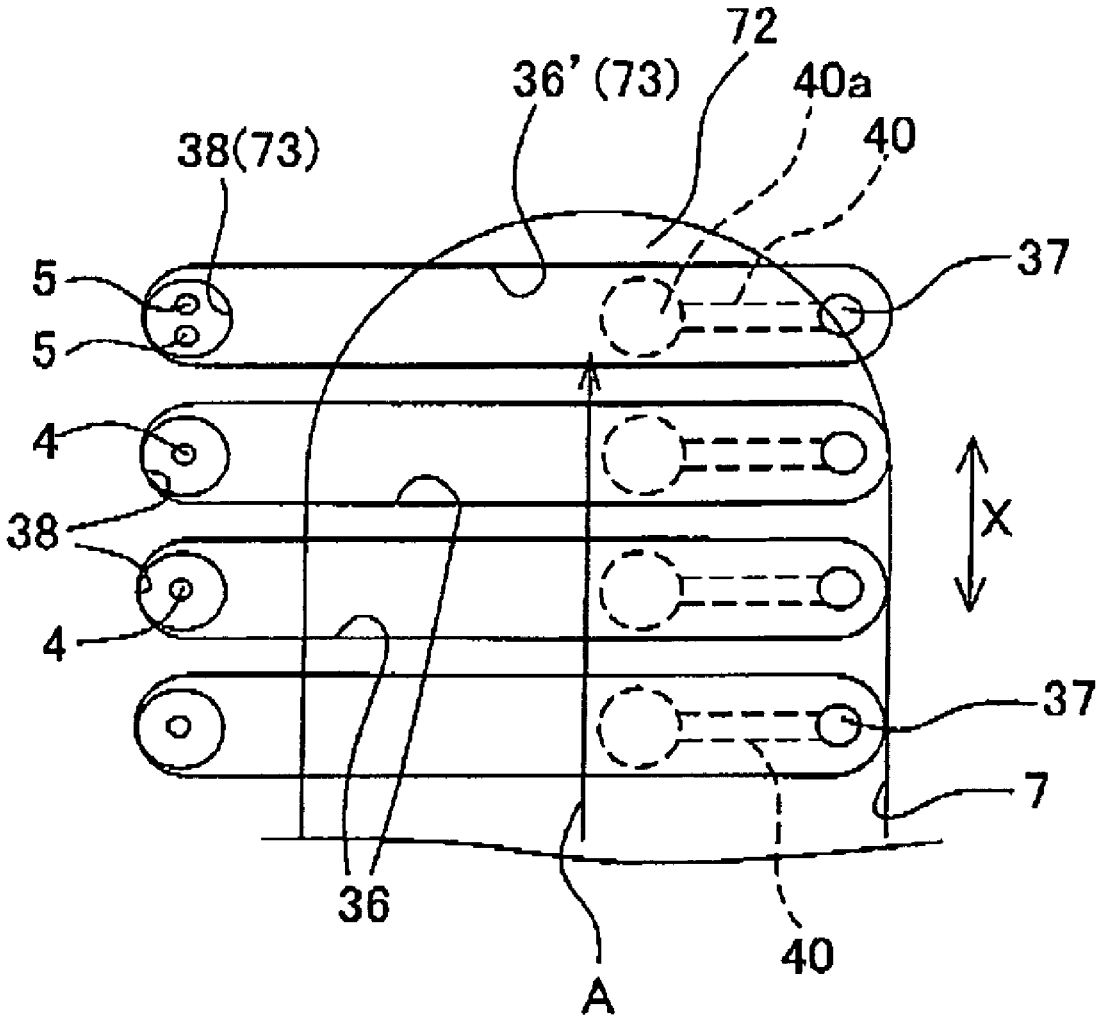
FIG. 6 is a plan view explaining a positional relationship between air discharge ports and channels reaching to nozzles respectively.

In each of the nozzle rows, two air discharge ports 5 for discharging air bubble are provided on an extension line of the nozzle row, and these two air discharge ports 5 are connected to a most downstream portion of a flow of the ink in a common ink chamber 7 (to be described later) by a single air discharge-channel 73 (to be described later). In this embodiment, the nozzles 4 and the air discharge ports 5 are formed through the nozzle plate 11 by a laser processing, and the ports and nozzles have a circular shape in a plan view and with a same diameter (same area of opening). Specifically, it is desirable that a diameter of each of the nozzle 4 and air discharge ports 5 is in a range of 0.015 mm to 0.025 mm. In this embodiment, the diameter of the nozzle 4 and the air discharge port 5 is 0.0205 mm in a case of black ink, and 0.0170 mm in a case of color ink. Further, as shown in FIG. 6, the two air discharge ports 5 arranged in one nozzle row are disposed substantially on the extension line of the nozzle row, and are arranged parallel to that extension line, or in a direction crossing the extension line. In each of the nozzle rows, a pitch between a middle point connecting centers of openings of the air discharge ports 5 and a nozzle 4 among the nozzles in the nozzle row and formed at a position nearest to the air discharge ports 5 is same as a pitch between the nozzles 4 formed in the nozzle row. Specifically, it is desirable that the pitch between the nozzles 4 is in a range of 0.1690 mm to 0.1695 mm. In this embodiment, the pitch is 0.1693 mm.

It is sufficient that the number of air discharge ports 5 is not less than two, and the number of the air discharge ports may be set arbitrarily provided that the number make it possible to connect the air discharge ports 5 to one air discharge-channel 73 which will be described later. Further, the air discharge ports 5 may be arranged substantially on the extension line of the nozzle row, and for example, in a case of arranging three pieces of the air discharge ports 5, it is allowable not only to arrange all of the three air discharge ports 5 on the extension line of the nozzle row, but also to arrange three pieces of the air discharge ports 5 in a triangular form such that the center of the triangle is disposed on the extension line of the nozzle row.

Figure 4:
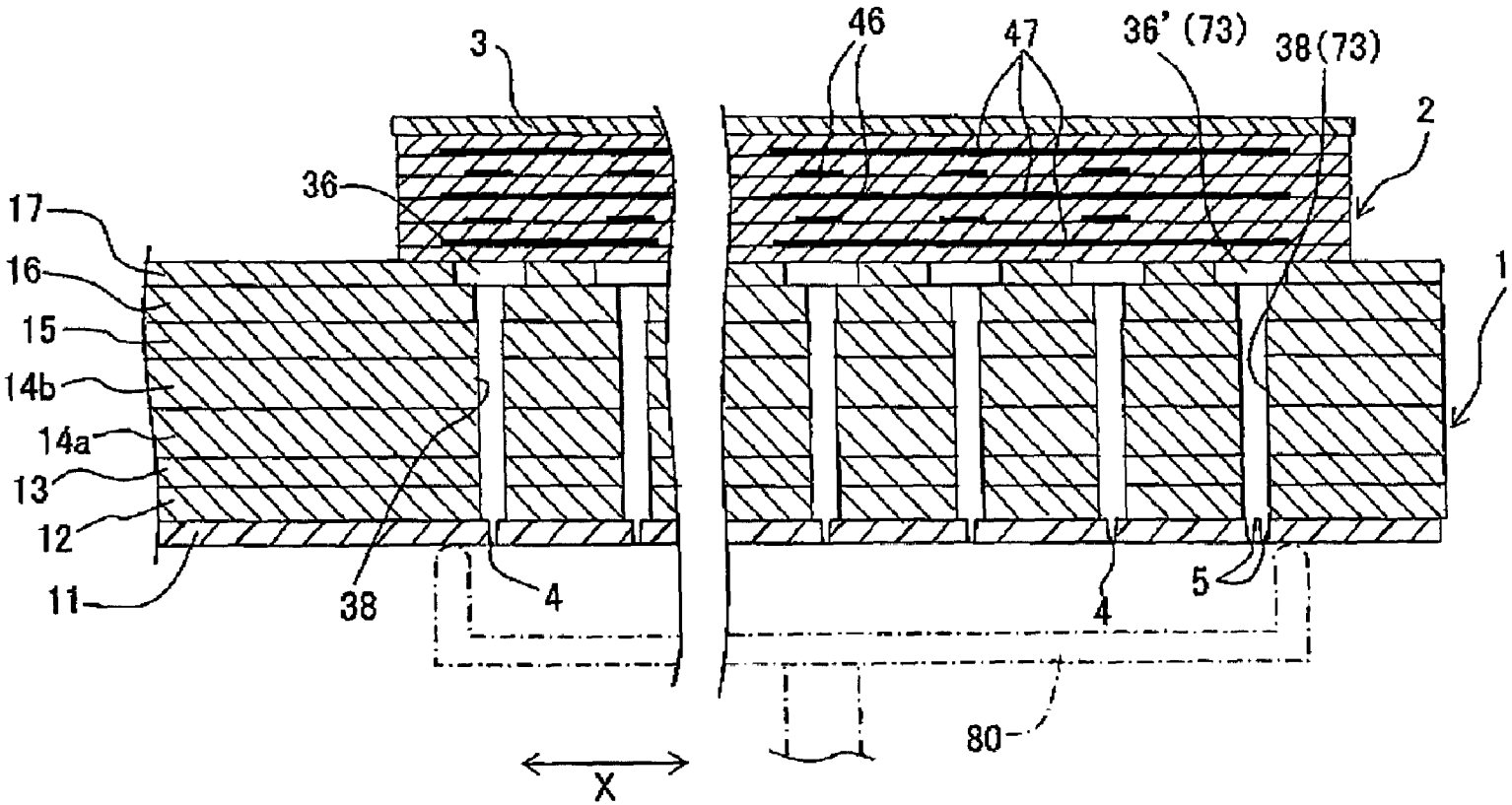
FIG. 4 is a cross-sectional view taken along a line IV-IV in FIG. 3.
Figure 5:
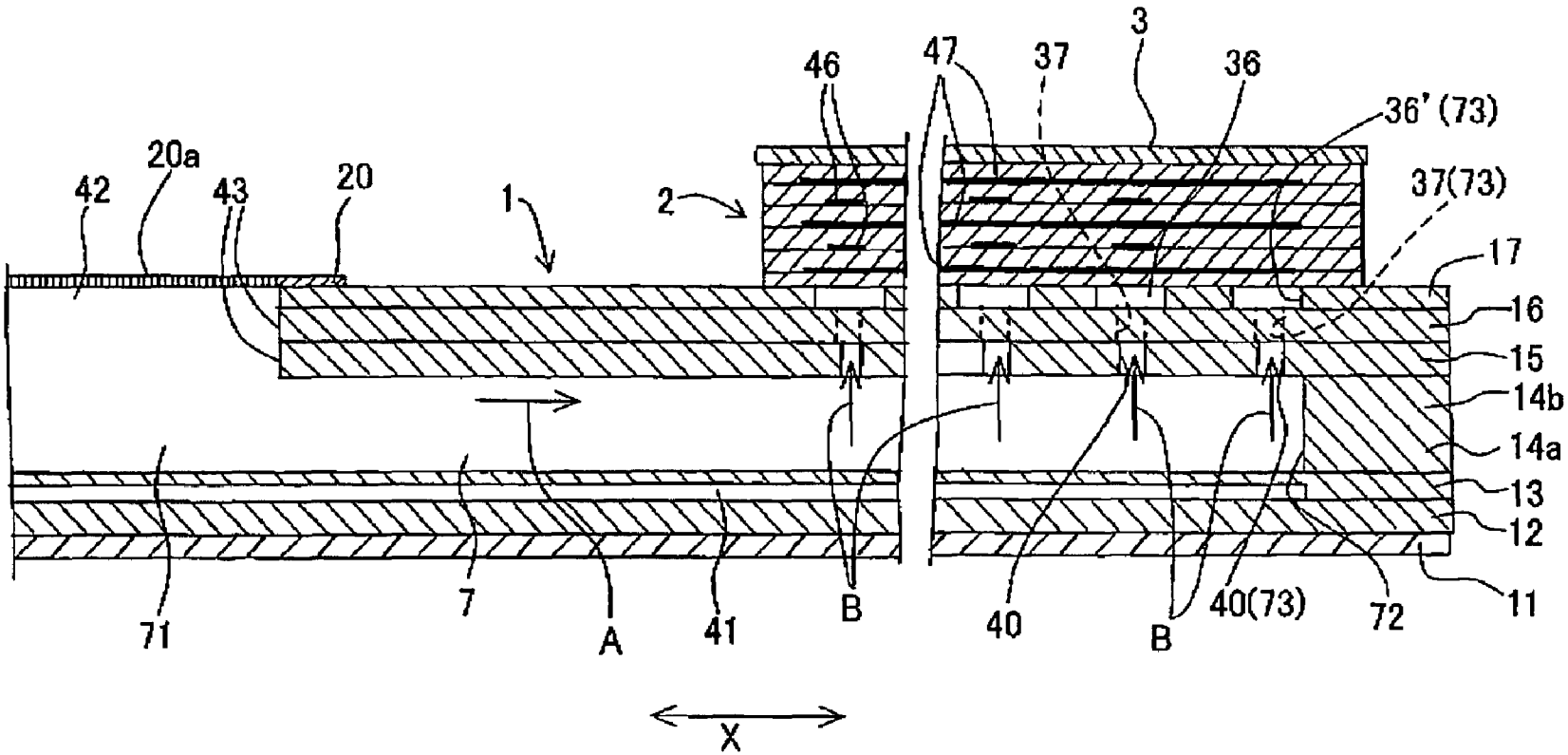
FIG. 5 is a cross-sectional view taken along a line V-V shown in FIG. 3.

As shown in FIGS. 4 and 5, the nozzles 4 and the air discharge ports 5 are connected to pressure chambers 36, respectively, formed in the cavity plate 17, each via a through channel 38 penetrating through the spacer plate 12, the damper plate 13, the two manifold plates 14*a* and 14*b*, the supply plate 15, and the base plate 16.

Figure 3:
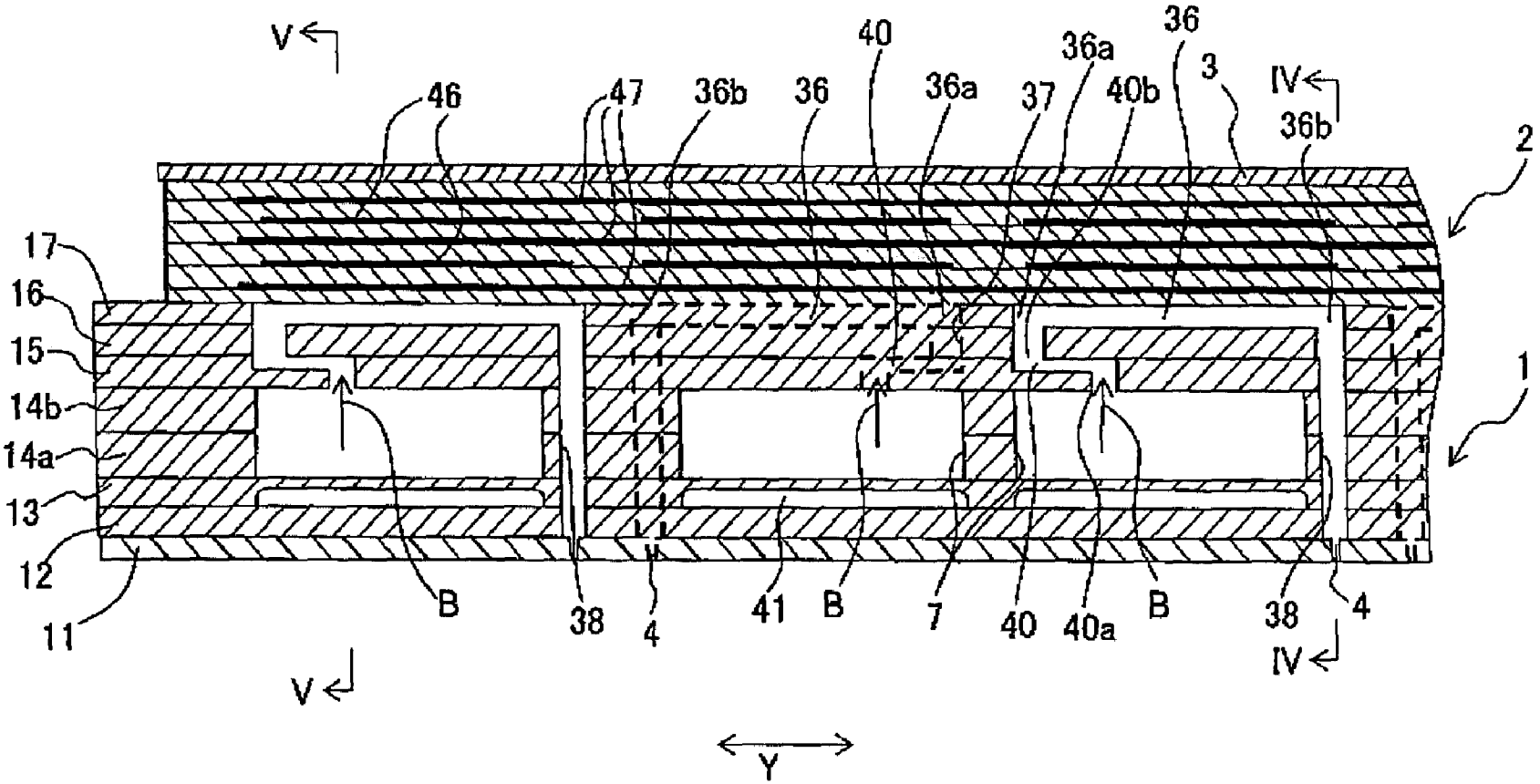
FIG. 3 is a cross-sectional view taken along a line III-III shown in FIG. 1.

As shown in FIG. 2, in the cavity plate 17, a plurality of pressure chambers 36 is arranged in five rows parallel to a direction of length (X direction) of the cavity plate 17. Each of the pressure chambers 36 has an elongated shape in a plan view, and is formed to penetrate through the cavity plate 17 such that a longitudinal direction of the pressure chamber 36 is along a short direction (Y direction) of the cavity plate 17. As shown in FIG. 3, each of the pressure chambers 36 communicates with the common ink chamber 7 at one end 36*a* in the longitudinal direction of each of the pressure chambers 36, via a connecting channel 40 and a communicating hole 37 which will be described later. The through channel 38 is connected to the other end 36*b* in the longitudinal direction of each of the pressure chambers 36. It is desirable that a length, of each of the pressure chambers 36, in the longitudinal direction is in a range of 1.10 mm to 1.50 mm, and the length in a short direction of the pressure chamber 36 is in a range of 0.25 mm to 0.30 mm. In this embodiment, the length in the longitudinal direction of a pressure chamber 36 for black ink is 1.42 mm and the length in the longitudinal direction of a pressure chamber 36 for color ink is 1.12 mm, and the length in the short direction of the pressure chambers 36 for black and color inks is 0.27 mm.

The communicating hole 37 connected to the one end 36*a* of each of the pressure chambers 36 is formed in the base plate 16 which is adjacent to the lower surface of the cavity plate 17.

Connecting channels 40 which supply the ink from the common ink chamber 7 to the pressure chambers 36, respectively, are provided in the supply plate 15 which is adjacent to the lower surface of the base plate 16. As shown in FIG. 3, each of the connecting channels 40 includes an inlet hole 40*a* through which the ink inflows from the common ink chamber 7, an outlet hole 40*b* which is open to face the communicating hole 37, and a throttle portion which is between the inlet hole 40*a* and the outlet hole 40*b*, and formed by reducing or narrowing a cross-sectional area such that a flow resistance in the throttle section is the maximum or greatest in the connecting channel 40. This throttle portion is provided for preventing the ink from flowing back toward the common ink chamber 7 and for making the ink advance efficiently toward the nozzle 4 when the pressure chamber 36 receives a discharging or jetting pressure for jetting the ink from the nozzle 4.

As shown in FIG. 2, in the two manifold plates 14*a* and 14*b*, the common ink chamber 7 is provided as five common ink chambers 7 formed along the longitudinal direction (X direction) of the plates 14*a* and 14*b* to penetrate through the plates such that the common ink chambers 7 extend along the rows of the nozzles 4, respectively. In other words, as shown in FIGS. 2, 3 and 5, the two manifold plates 14*a* and 14*b* are stacked as laminated layers, and the upper surface of this stacked structure is covered by the supply plate 15, and the lower surface of the stacked structure is covered by the damper plate 13, thereby forming total five pieces of the common ink chambers (manifold chambers) 7. Each of the common ink chambers 7, as viewed in a plan view from a direction in which the plates are stacked (stacking direction), is extended to be long along a direction in which the row of pressure chambers are aligned (row direction of the nozzles 4) to overlap partially with the pressure chambers 36 in the pressure-chamber row.

As shown in FIGS. 2, 3 and 5, damper chambers 41 isolated from the common ink chambers 7 respectively, are formed as recesses in the damper plate 13 in the lower surface thereof which is adjacent to the lower surface of the manifold plate 14*a*. A position and a shape of each of the damper chambers 41 are matched with those of one of the common ink chambers 7, as shown in FIG. 2. Since the damper plate 13 is made of a metallic material which is elastically deformable as appropriate, a ceiling portion in a form of a thin plate on each of the damper chambers 41 can also be vibrated freely toward the common ink chamber 7 as well as toward the damper chamber 41. At a time of ink discharge, even when a pressure fluctuation (change) generated in a certain pressure chamber 36 is propagated to the common ink chamber 7, there is obtained a damper effect in which the pressure fluctuation is absorbed and attenuated by vibration upon elastic deformation of the ceiling portion, thereby suppressing cross-talk in which the pressure fluctuation in the certain pressure chamber is propagated to another pressure chamber 36.

Further, as shown in FIG. 2, four ink supply ports 42 are formed, as inlets for the ink flowing into the cavity unit 1, in the cavity plate 17 at a portion on one short-side end thereof. Four connecting ports 43 are formed as holes in each of the base plate 16 and the supply plate 15, at positions vertically corresponding to the positions at which the four ink supply ports 42 are formed, respectively. Ink from an ink supply source is inflowed to one end 71 in the longitudinal direction of each of the common ink chambers 7, via the ink supply port 42 and the connecting port 43, as shown in FIG. 5. A filter 20 having filter portions 20*a* is adhered, by using an adhesive or the like, with respect to the four ink supply ports 42, so that the filter portions 20*a* correspond to the openings of the four ink supply ports 42, respectively.

In this embodiment, four pieces of the ink supply ports 42 and four pieces of the connecting ports 43 are provided, whereas five pieces of the common ink chambers 7 are provided, and only one ink supply port 42, among the ink supply ports 42, which is positioned at the left end in FIG. 2 is structured to supply ink to two common ink chambers 7 among the common ink chambers 7. A setting is made to supply a black ink to this ink supply port 42 at the left end in FIG. 2, taking into consideration that the black ink is used highly frequently as compared to other color inks. The color inks other than black, such as yellow, magenta, and cyan inks are supplied separately to the remaining ink supply ports 42, respectively.

As described above, each of the ink supply ports 42 is connected to one end 71 in the longitudinal direction of one of the common ink chambers 7. Accordingly, in each of the common ink chambers 7, a flow of the ink is generated from one end 71 in the longitudinal direction to the other end 72 (see arrow A in FIG. 5 and FIG. 6), and the other end 72 becomes the downstream-most portion. A portion ranging from the common ink chamber 7 up to each of the nozzles 4 is connected by one of the ink channels each formed by one of the connecting channels 40, one of the communicating holes 37, one of the pressure chambers 36, and one of the through holes 38, so as to generate an ink flow in which the ink is distributed from the common ink chamber 7 to each of the ink channels (see an arrow B in FIGS. 3 and 5).

As shown in FIG. 2, since the nozzles 4 are formed in rows along the longitudinal direction of the common ink chambers 7, respectively, the ink channels are formed also in rows corresponding to the position of nozzles 4. In this embodiment, as shown in FIGS. 4 and 5, in each of the rows of the ink channels (ink-channel rows), an ink channel, among the ink channels, which is positioned at a side farther (hereinafter described as "tail end") from the corresponding ink supply port 42, namely, one ink channel, among the ink channels, located at a position which is the downstream-most position in the common ink chamber 7, is used as an air discharge-channel 73 connected to the air discharge ports 5. Further, as shown in FIG. 4, two pieces of the air discharge ports 5 provided at the tail end of each of the nozzle rows are connected to the single air discharge-channel 73 which is positioned at the tail end of each of the ink channel-rows. Thus, since one ink channel, among the ink channels for recording, is converted to the air discharge-channel 73, the air discharge-channel 73 and the ink channels are arranged at a pitch which is same as the pitch between the ink channels, and the air discharge-channel 73 and the ink channels have a same channel length and a same cross-sectional area in a direction orthogonal to the ink flow, namely, have the same shape. It is also allowable that a plurality of ink channels, among the ink channels, which are connected to the common ink chamber 7 at a downstream portion thereof are used as air discharge-channels 73.

On the other hand, the piezoelectric actuator 2 is similar to a hitherto known actuator disclosed in Japanese Patent Application Laid-open No. 4-341853 (corresponding to U.S. Pat. No. 5,402,159). In other words, the piezoelectric actuator 2 includes a plurality of ceramics layers which are flat, which have a size spreading to cover all the pressure chambers 36, and which are stacked in a direction orthogonal to a direction of the flatness thereof, and a plurality of electrode layers which are arranged in the flat surface of the stacked ceramics layers; and the piezoelectric actuator 2 imparts an ink jetting energy (ink discharge energy) with respect to the pressure chambers 36. This embodiment uses, as the ceramics layer, a sheet (green sheet) of a piezoelectric ceramics material which is formed to be flat such that a thickness of one sheet is about 30 μm, in which ceramics powder, a binder, and a solvent are mixed. The electrode layers are formed, on a sheet surface of a suitable number of green sheets among a plurality of green sheets of the piezoelectric ceramics material, by a method such as a printing with an electroconductive paste; and the piezoelectric actuator 2 is formed by stacking these green sheets and then by performing baking. Accordingly, each of the green sheets becomes a ceramics layer of a sintered body.

As the electrode layers, there are provided layers of drive electrodes in which electrode layers each having individual electrodes 46 formed therein corresponding to one of the pressure chambers 36 and electrode layers each having a common electrode formed therein to cover the pressure chambers 36 are paired in a direction in which the ceramics layers are stacked; and a surface-electrode layer arranged on the uppermost surface of the stacked ceramics layers and having surface electrodes 48 (see FIG. 1) formed therein, the surface electrodes being electrically connected to the flexible flat cable 3. In the piezoelectric actuator 2 provided with the electrode layers in such manner, when a predetermined electric potential is selectively applied to a plurality of individual electrodes 46, an electric potential difference is developed between the individual electrodes 46 to which the predetermined electric potential is applied, and the common electrode which is kept at the ground electric potential. At this time, an electric field in a direction of thickness of the ceramics layers, which is a polarization direction of the ceramics layers, is generated in the ceramics layers sandwiched between the individual electrodes 46 and the common electrodes. Therefore, the ceramics layers are elongated in the direction of thickness thereof due to the piezoelectric effect. Accordingly, since a volume of a pressure chamber 36, corresponding to the individual electrodes 46 applied with the electric potential, is decreased, a pressure in the ink in the pressure chamber 36 is increased, thereby jetting an ink droplet from a nozzle 4 communicating with the pressure chamber 36.

As shown in FIG. 6, the air discharge-channel 73 includes a dummy pressure chamber 36' which has a shape same as that of the pressure chamber 36. The air discharge-channel 73 is not used for the jetting of the ink. Accordingly, although this embodiment adopts the structure in which the individual electrodes 46 corresponding to the dummy pressure chamber 36' are omitted (see FIGS. 4 and 5), it is also allowable that the individual electrodes 46 are provided corresponding to the dummy pressure chamber 36' and no driving signal is applied.

An adhesive sheet (not shown in the diagram) made of an ink non-permeable synthetic resin material is stuck in advance entirely on the lower surface (broad surface facing the pressure chambers 36) of the plate-shaped piezoelectric actuator 2 having such structure. Next, the piezoelectric actuator 2 is adhered and fixed to the cavity unit 1 such that each of the individual electrodes in the actuator 2 corresponds to one of the pressure chambers 36 in the cavity unit 1. Further, by joining the flexible flat cable 3 (see FIG. 3) to a surface on the upper side of this piezoelectric actuator 2, various types of wiring patterns (not shown in the diagram) in the flexible flat cable 3 are electrically connected to the surface electrodes 48, respectively.

In the ink-jet head 100 as described above, the ink inflowed in each of the common ink chambers 7, while flowing from one end 71 to the other end 73 (direction of the arrow A) of the common ink chamber, changes its direction in the ink flow at right angles toward an inlet hole of each of the connecting channels 40 (direction of the arrow B), then distributed to each of the ink channels, and supplied to each of the nozzles 4. At the other end 72 of the common ink chamber 7, an area in which no ink flow occurs (no-flow area), is generated; and air bubbles easily stagnate or remain in this no-flow area. However, as described above, at the other end 72 corresponding to the no-flow area, the air discharge-channel 73 communicating with the air discharge ports 5 is connected.

As a purge operation performed at a time of maintenance, as shown in FIG. 4, when a portion of the nozzle plate 11 in which the openings of the nozzles 4 are formed (front side in the surface of the nozzle plate 11) is covered by a cap 80 and the ink is sucked from a side of the nozzles 4 (pressure may be applied from a side of the ink supply ports 42), then the ink is discharged forcibly from the nozzles 4, and solidified ink and/or air bubbles in the ink are discharged together with the ink. At this time, the air discharge-channel 73 is opened so as to be close to or to make a contact with the air bubbles stagnated or remained in the no-flow area of the common ink chamber 7. Accordingly, at the time of the purge operation, it is possible to discharge promptly and positively the air bubbles in the no-flow area of the common ink chamber 7.

In particular, although the air discharge-channel 73 has a shape same as that of the ink channels, the air discharge-channel 73 is communicated with the two air discharge ports 5 each having an opening area same as that of the nozzle 4. Therefore, in the air discharge-channel 73, the flow resistance is lower than that in the ink channels. Consequently, when suction is performed by the purge operation, the air discharge-channel 73 has a discharge capacity higher than a discharge capacity of the ink channel. Therefore, a substantial flow of the ink is generated in the common ink chamber 7, thereby making is possible to quickly discharge the air bubbles stagnated in the common ink chamber 7 at a portion thereof on the downstream-most side of the ink flow. In this embodiment, although the air discharge-channel 73 has a shape same as that of the ink channel, the air discharge-channel 73 may have a shape different from that of the ink channel, provided that the channel resistance is lower in the air discharge-channel 73 than the channel resistance in the ink channel.

Further, since the air discharge-channel 73 is exclusively used for air discharge and is not used for the ink jetting (ink discharge), it is possible to arrange the inlet hole 40*a* of the connecting channel 40, in the air discharge-channel 73, upon taking into consideration only the removal of the air bubble. In other words, since there is no need at all to take into consideration the discharge capability of ink and the like, a position of the inlet hole 40*a* may be set to be closer to a wall surface at the other end 72 of the common ink chamber 7, and it is also possible to arrange the inlet hole 40*a* to communicate assuredly with a position (portion) at which the ink is easily stagnate or remain.

Further, since the air discharge ports 5 are arranged on a substantial extension line of the nozzle row, even when a space between the adjacent nozzle rows is narrowed due to the reduction in size of the entire ink-jet head 100, there is no fear that the arrangement of the air discharge ports 5 cannot be made.

In this embodiment, the nozzles 4 as well as the air discharge ports 5 are formed to be circular shaped in a plan view, and having the same diameter (same opening area). However, the opening area of the air discharge ports 5 may be not more than the opening area of the nozzles 4.

Figure 7:
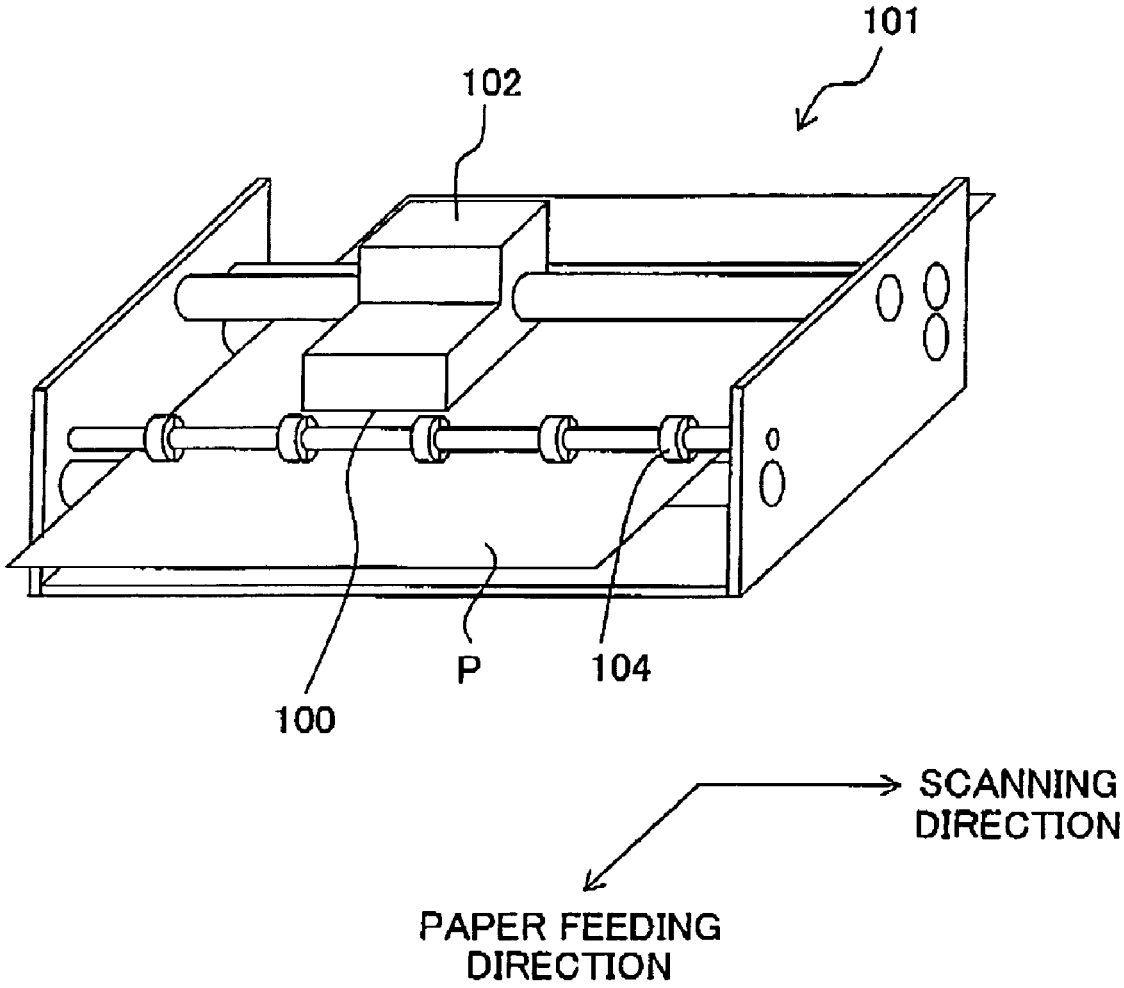
FIG. 7 is s schematic perspective view of an ink-jet printer provided with the ink-jet head of the present invention.

Finally, a brief explanation will be given about an ink-jet printer which uses the ink-jet head according to the present invention, with reference to FIG. 7. As shown in FIG. 7, an ink-jet printer 101 includes a carriage 102 which is movable in a scanning direction (left and right direction in FIG. 7); an ink-jet head 100 of piezoelectric type according to the present invention, which is constructed to be movable together with the carriage 102, and which jets the ink onto a recording paper P (recording medium); and paper transporting rollers 104 (transporting mechanism) which transport or feed the recording paper P in a paper feeding direction (forward direction in FIG. 7); and the like. The ink-jet head 100 is constructed to move integrally with the carriage 102 in the scanning direction, and perform printing on the recording paper P by jetting ink from jetting ports of the nozzles 4 (see FIG. 4) arranged on the lower surface of the ink-jet head. Further, the recording paper P with the printing performed thereon by the ink-jet head 100 is discharged in the paper feeding direction by the paper transporting rollers 104.

What is claimed is:

1. An ink-jet head comprising:

a cavity unit including a nozzle row in which a plurality of nozzles for recording are arranged in a row, a common ink chamber extending along the nozzle row and distributing an ink, supplied from an ink supply source, to each of the nozzles, and ink channels connecting the common ink chamber with the nozzles, respectively;

at least two air discharge ports for air-bubble discharge which are provided substantially on an extension line of the nozzle row, and a single air discharge-channel which connects the at least two air discharge ports and a portion, of the common ink chamber, which is disposed at most downstream in a flow of the ink.

2. The ink-jet head according to claim 1, wherein an area of opening of each of the air discharge ports is substantially same as an area of opening of each of the nozzles.

3. The ink-jet head according to claim 1, wherein an area of opening of each of the air discharge ports is not more than an area of opening of each of the nozzles.

4. The ink-jet head according to claim 1, wherein the cavity unit is formed of a plurality of stacked plates; and the nozzles and the air discharge ports are formed through a same plate among the stacked plates.

5. The ink-jet head according to claim 1, wherein the air discharge-channel has a shape substantially same as that of the ink channels.

6. The ink-jet head according to claim 1, further comprising: pressure chambers each of which communicates with the common ink chamber and one of the nozzles; and a piezoelectric actuator which imparts an ink jetting energy to the pressure chambers;

wherein the air discharge-channel includes a dummy pressure chamber having a shape same as that of each of the pressure chambers.

7. An ink-jet printer which performs printing by jetting an ink onto a recording medium, comprising:

a transporting mechanism which transports the recording medium in a predetermined direction; and an ink-jet head which includes: a cavity unit having a nozzle row in which a plurality of nozzles for recording are arranged in a row, a common ink chamber extending along the nozzle row and distributing an ink, supplied from an ink supply source, to each of the nozzles, and ink channels connecting the common ink chamber with the nozzles, respectively; at least two air discharge ports for air-bubble discharge which are provided substantially on an extension line of the nozzle row; and a single air discharge-channel which connects the at least two air discharge ports and a portion, of the common ink chamber, which is disposed at most downstream in a flow of the ink.

8. The ink-jet printer according to claim 7, wherein an area of opening of each of the air discharge ports is substantially same as an area of opening of each of the nozzles.

9. The ink-jet printer according to claim 7, wherein an area of opening of each of the air discharge ports is not more than an area of opening of each of the nozzles.

10. The ink-jet printer according to claim 7, wherein the cavity unit is formed of a plurality of stacked plates; and the nozzles and the air discharge ports are formed through a same plate among the stacked plates.

11. The ink-jet printer according to claim 7, wherein the air discharge-channel has a shape substantially same as that of the ink channels.

12. The ink-jet printer according to claim 7, wherein:

the ink-jet head further includes pressure chambers each of which communicates with the common ink chamber and one of the nozzles, and a piezoelectric actuator which imparts an ink jetting energy to the pressure chambers; and the air discharge-channel includes a dummy pressure chamber having a shape same as that of each of the pressure chambers.

* * * * *